US006723909B1

(12) United States Patent
Hooper, II

(10) Patent No.: US 6,723,909 B1
(45) Date of Patent: Apr. 20, 2004

(54) GIG BOX

(76) Inventor: Harry Joe Hooper, II, 301 Preakness Dr., Antioch, TN (US) 37013

( * ) Notice: Subject to any disclaimer, the term of this patent is extended or adjusted under 35 U.S.C. 154(b) by 0 days.

(21) Appl. No.: 10/349,620

(22) Filed: Jan. 23, 2003

Related U.S. Application Data

(60) Provisional application No. 60/350,582, filed on Jan. 24, 2002.

(51) Int. Cl.[7] ..... G10G 3/00
(52) U.S. Cl. ..... 84/453; 84/177
(58) Field of Search ..... 84/453, 422.1, 84/177

(56) References Cited

U.S. PATENT DOCUMENTS 5,866,829 A * 2/1999 Pecoraro ..... 84/177
6,215,055 B1 * 4/2001 Saravis ..... 84/422.1
6,459,023 B1 * 10/2002 Chandler ..... 84/177
6,545,204 B1 * 4/2003 Wadell ..... 84/422.1

OTHER PUBLICATIONS

Website musicyo.com Sales Ad for Electar PBX–1000 Pedal Board, Aug. 29, 2001.
Website www.furmansound.com sales ad for Stereo Pedal Board/Power Conditioner, Sep. 7, 2001.
Website—www.musiciansfriend.com sales ad for PS–25 Pedal Board, Sep. 7, 2001.
Website—www.cybozone.com Sales article entitled Fully–Powered Special Effects Pedal Board Signal–Routing, Oct. 27, 2001.
Website—www.todomusica.com sales ad for SKB PS–100 Pedal Board, Oct. 27, 2001.
Website—www.harmony–central.com sales ad for Electar PBX–1000 Pedal Board, Oct. 27, 2001.

* cited by examiner

*Primary Examiner*—Kimberly Lockett
(74) *Attorney, Agent, or Firm*—Waddey & Patterson; I. C. Waddey, Jr.

(57) ABSTRACT

The invention is a new system for simplifying the transport, set-up and use of electrically amplified musical instruments such as guitars and electric bases. It is comprised of a combination of components that are normally carried and set-up separately by the performer and thereby saves the performer considerable time and effort in transport and set-up of his equipment. Included in the invention are an integrated accessory case, guitar stand and pedal effects board. Additional features provide the special protection required for effects pedals during transport.

21 Claims, 4 Drawing Sheets

GIG BOX

This application claims benefit of co-pending U.S. Provisional Patent Application Ser. No. 60/350,582 filed Jan. 24, 2002, entitled "Gig Box " which is hereby incorporated by reference. Be it known that I, Harry Joe Hooper II, a citizen of The United States, residing at 301 Preakness Drive, Antioch, Tenn. 37013; have invented a new and useful "Combination Effects Pedal Board, Instrument Stand and Accessory Case for Electrically Amplified Musical String Instruments ".

This invention relates to carrying cases, sound effects apparatus, instrument stands and other accessories for musicians to aid in transporting and setting up string instruments including, but not limited to electric guitars and electric basses.

BACKGROUND OF THE INVENTION

When guitarists and bassists using electrically amplified instrument go to work on location, they almost always require musical instruments, an amplification system, one or more instruments stands, a set of sound effects devices commonly known in the trade as pedals, and the cables required to interconnect and power the amplifier, pedals and instruments. Moving and setting up all the required equipment can require a considerable amount of effort and time. This invention addresses a large part of the transport and set-up problems by integrating a number of the required components into a single container that acts as a storage and transport case and as a musical instrument stand. An additional advantage of this invention is to simplify the musician's set-up procedure by providing a mounting board for the effects devices, with the devices mounted and connected in a predetermined configuration.

Prior art has not yet integrated all of the above said functions into one system and required the transport and set-up of a plurality of components requiring additional effort and time and increasing the probability of cable and/or equipment failure through the additional repeated handling of interconnection cables and increased insertions into the electrical jacks of the various components. In addition to providing storage area for peripherals and accessories, the device provides a safe and secure stand for multiple electric or acoustic instruments. The device of the present invention can also be configured to provide a repair surface option for the repair and maintenance of electric or acoustic instruments, as well as tools for the maintenance of said instruments.

BRIEF DESCRIPTION OF THE INVENTION

This invention is comprised of a two part carrying case housing a stand for multiple musical instruments, a pedal effects board and provisions for organizing and storing various accessories needed by guitarists and/or bassists to set-up, interconnect and operate a musical performance system. Said accessories include audio cables, tuning devices, power cables, neck straps and spare strings, as well as tools for the maintenance of said instruments.

OBJECTS OF THE INVENTION

The primary objects of the invention are to provide a compact, secure and convenient system for storing, transporting and setting up electrically amplified or acoustic string instruments, pedals and accessories.

Secondary objects of the invention are to provide safe and secure stands for a plurality of musical instruments and to reduce the time and effort involved in transporting, setting up and stowing accessories needed by the musician.

SUMMARY OF THE INVENTION

The invention disclosed herein includes, in combination, musical instrument stands for guitarists and bassists, along with a system for storing and transporting accessories.

The invention is comprised of a two part carrying case having separable hinges and locking devices, an integrated musical instrument stand for holding a plurality of musical instruments, an effects pedal board and storage compartments and areas.

DETAILED DESCRIPTION OF THE PREFERRED EMBODIMENT

Figure 1:
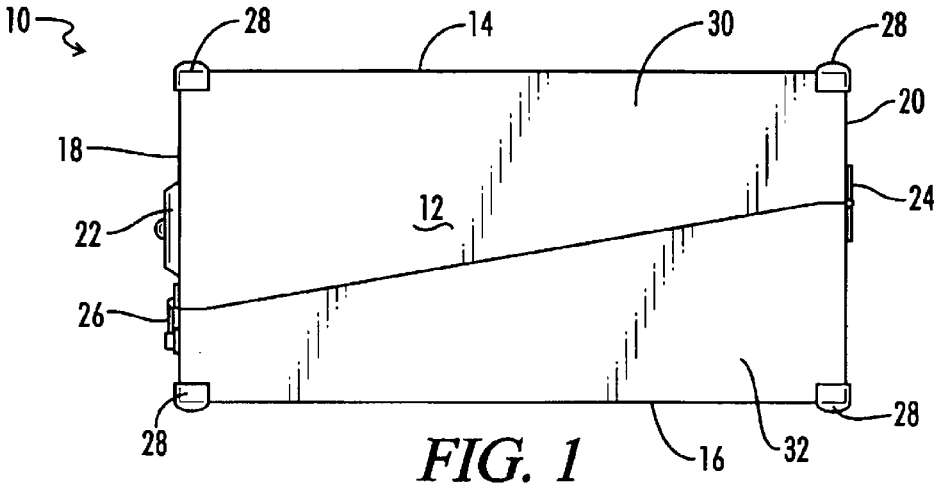
FIG. 1 is a side view of the device of the present invention.
Figure 2:
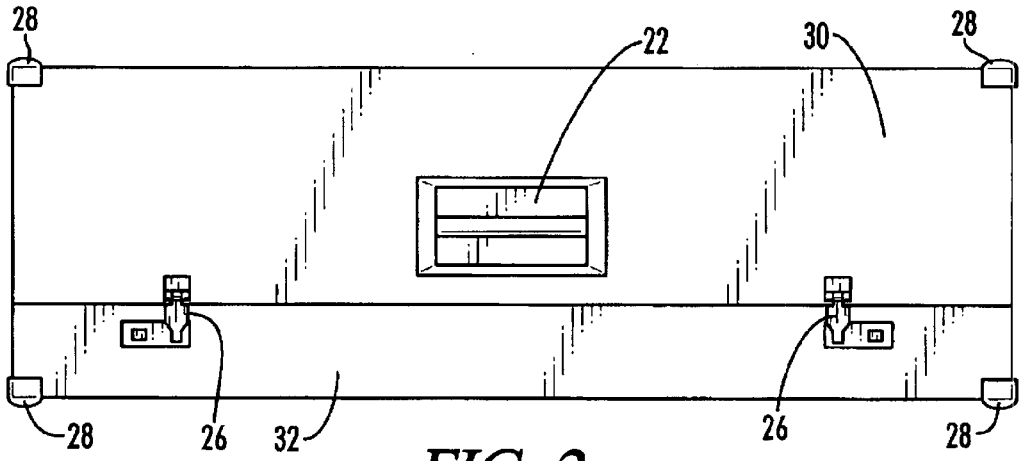
FIG. 2 is a front view of the device of the present invention.
Figure 3:
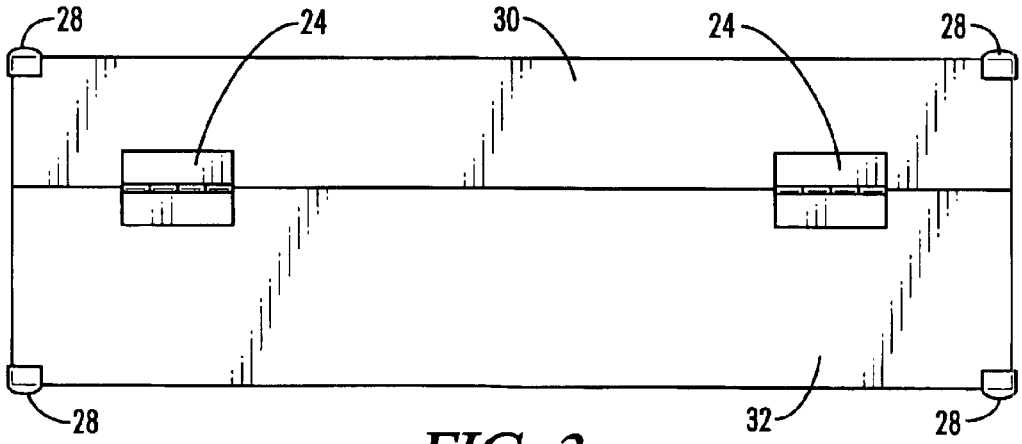
FIG. 3 is a back view of the device of the present invention.
Figure 4:
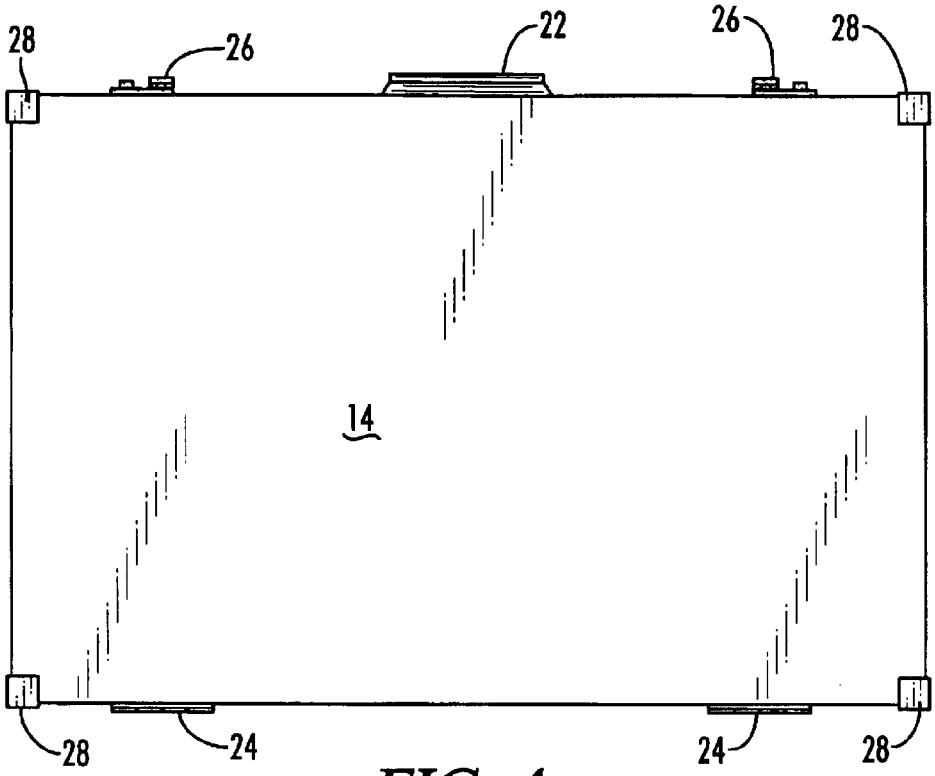
FIG. 4 is a top view of the device of the present invention.

The preferred embodiment of the invention will now be described in conjunction with the accompanying drawings wherein like numerals represent identical parts. It is to be understood however that the description of the preferred embodiment is illustratively only and does not constitute a limitation on the scope of the invention as is set forth more particularly in the claims appended hereto. Further more, one of ordinary skill in the art will recognize that there are various modifications within the scope of the invention described herein.

Referring now to FIGS. 1 through 4, the preferred embodiment of the acoustic-amplified music accessory case 10 is illustrated. The case is generally configured in the shape of a box having sides 12, a top 14, a bottom 16, a front 18 and a back 20. The case is formed in two sections; a top section 30 and a bottom section 32. A pair of hinges 24 mounted on the back of the case hingedly connects the top and bottom sections 30, 32. The hinges 24 are J shaped so that they will hold the two sections of the case together, but when the two sections are opened and pivoted about the hinges, the open flange of the hinge can be separated from the pivot bar of the hinge to separate the two sections of the case. The hinges are old and well known in the art and are not specifically illustrated in detail in the drawings.

On the front of the case is a handle 22 mounted on the top section 30. A musician using the device uses the handle 22 to carry the case from one venue to another.

On the front of the case, there are lock clasps 26 of the type often found on flight-road cases and which are well known in the industry. For protection, the corners of the case are covered by hard plastic or rigid steel corner caps 28, which can also serve as feet for the two sections of the case when the case is opened to an operable position.

Figure 5:
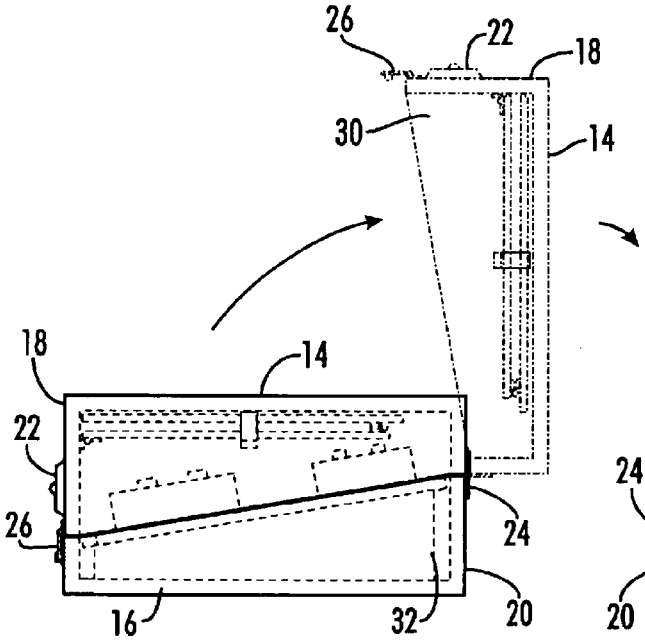
FIG. 5 is a side view of the device of the present invention showing the top section of the device in dotted lines as the top is being opened.
Figure 6:
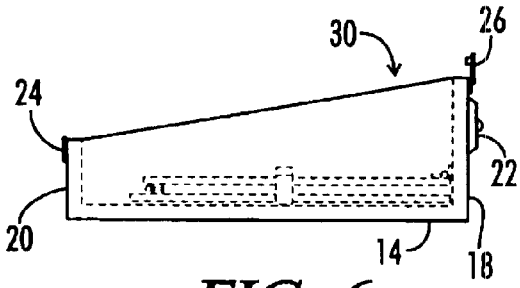
FIG. 6 is a side view of the top section of the device of the present invention opened and separated from the bottom section of the device.

Looking now at FIGS. 5 and 6, the case is illustrated in transition from a closed configuration to a separated configuration. In FIG. 5, the case is shown in full lines with the foot pedals, guitar stand and accessory cavity (all of which will described in more detail later) shown in phantom lines. Also FIG. 5 shows the top section 30 of the case itself in phantom lines as the case is being opened by pivoting the top section against the hinges 24.

Figure 7:
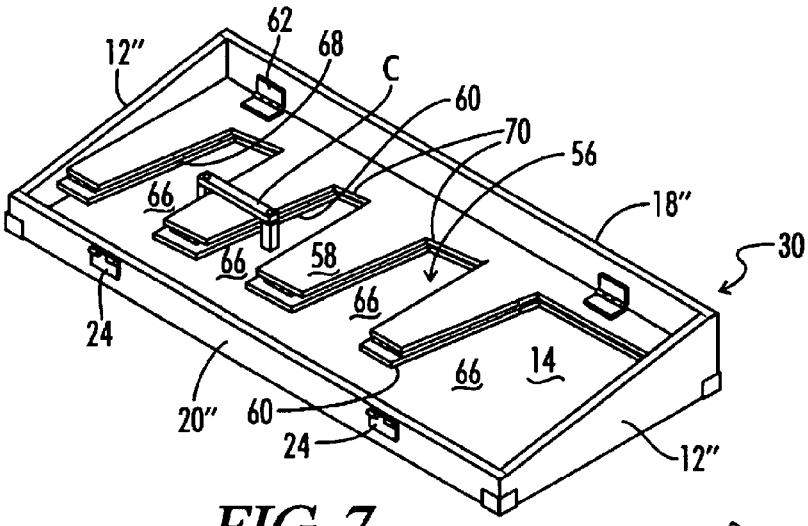
FIG. 7 is a perspective view of the top section of the device.

Once the top section has been opened about the hinges 24, each hinge is configured so that it will separate and will allow the top portion of the case to be removed and set in a "upside down " position as is shown in FIG. 6. FIGS. 7–9 illustrate the top section of the case in the upside down position.

After the top section 30 of the case is separated from the bottom section 32, the top section will appear as is illustrated in FIG. 7. The top section 32 has a top chamber 56 formed between the inside surface of the top 14, the sides 12", the inside surfaces of the front 18" and the back 20".

Figure 8A:
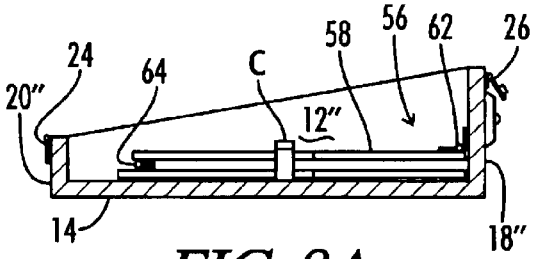
FIG. 8A is a side cross-section view of the top section of the device with the guitar stand shown in the collapsed position.
Figure 8B:
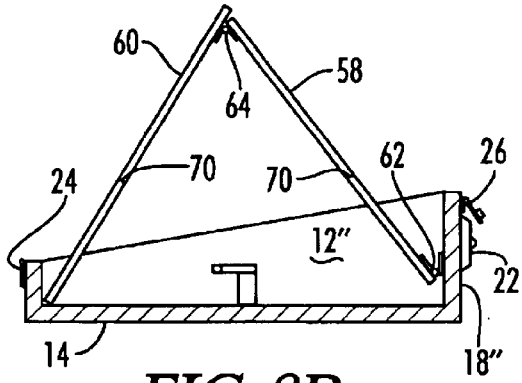
FIG. 8B is a side cross-section view of the top section of the device with the guitar stand shown in the expanded position.
Figure 9:
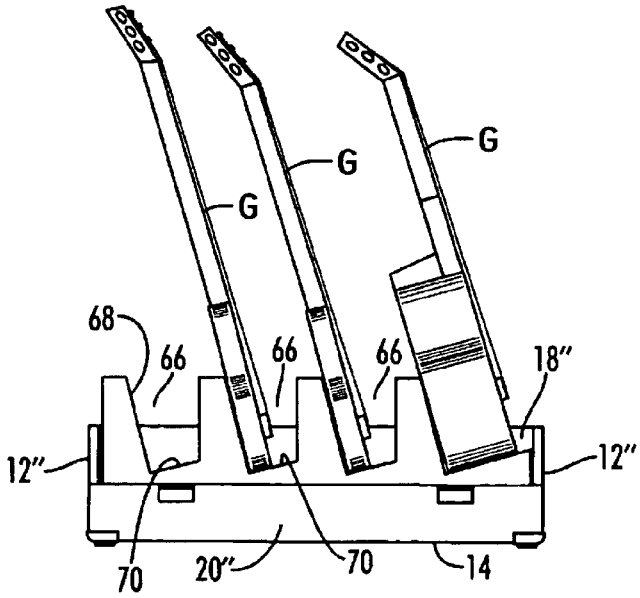
FIG. 9 is a front view of the top section of the device showing the guitar stand expanded with guitars sitting in the wells of the stand.

Fitted within the top chamber 56 is a guitar stand as is shown in the FIGS. 8A and 8B. The guitar stand is constructed with a front panel 58 and a back panel 60. The front panel 58 is hingedly connected to the inside of the front 18". Generally, there are two hinges 62 connecting the panel 58 to the inside of the front 18" of the top section 30. The two panels 58 and 60 each have sawed tooth like profiles that generally mirror each other and when the device is opened to its operable configuration, form wells 66 to serve as stands for multiple musical instruments. The back panel 60 is hinged to the front panel 58 along the panel edge opposite the edge where the front hinges 62 are attached to the inside of the top section of the case. The hinges 64 generally connect each one of the teeth like protrusions of the panels that are created by the gaps that form the wells 66.

When the guitar stand is in the stored position for transportation, the back panel 60 pivots about the hinges 64 and folds underneath the front panel 58 and the two panels lay flat against each other and against the inside surface of the top 14. The panels are held in place by a clasp C that fits over one of the teeth-like sections of the panels and can be released either by a snap, button, hook and loop fabric connection, or other industry standard connection device.

When the musician reaches the music venue and the case is open and separated, the top section is separated as shown in FIG. 7. The guitar stand is then opened by releasing the clasp C and the front panel 58 is rotated about the hinges 62 to an angle as is illustrated in FIG. 8B. The back panel 60 is then rotated about the hinge 64 to spread the two panels into an angled configuration as is shown in FIG. 8B. The edge of the panel 60 opposite the edge that is hinged to panel 58 is then fitted into the corner of the top section of the case formed between the back 20" and the top 14 so that the two panels form a pyramidal support structure when viewed from the back of the case.

Looking from the back to the front of the case, as can be seen in FIG. 9, when the guitar stand is in an operable position, the wells 66 are formed from the support backs 68 in the saw tooth cut in the panels and the support base 70. There are multiple wells 66 so that multiple musical instruments can be placed in the wells and made readily accessible to the musician during the course of his or her performance. As each musical instrument or guitar G is used for performance, it is removed from the well 66, plugged into the outlet in the pedal board 42 (discussed in greater detail hereinafter) and is ready to be played with all the benefits of the amplified music accessory pedals 50 that are mounted and wired onto the pedal board 42.

Figure 10:
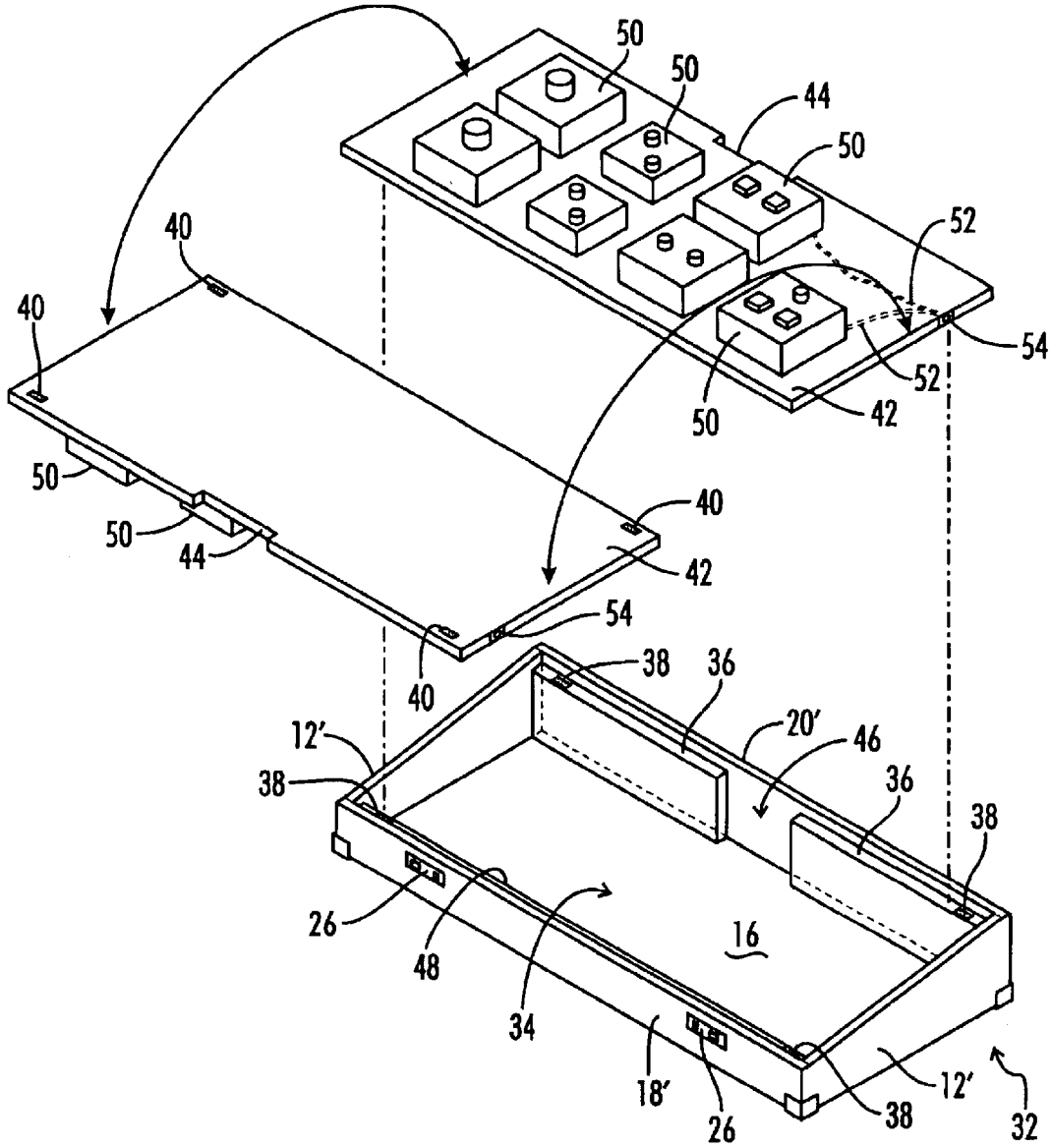
FIG. 10 is a perspective, exploded view of the bottom section of the device with the accessory pedal board shown lifted from the bottom section and rotated to a position to illustrate the underside of the pedal board.

Looking next at FIG. 10, there is shown an exploded view of the bottom section 32 of the case with the top section removed to another location. The bottom section 32 includes a bottom chamber 34 in the space between the bottom 16, sides 12', front 18' and back 20'. Within the top chamber 34 there are spacers 36 mounted against the inside of the bottom 16 and the inside of the back 20'. In addition there is a front spacer 48 that is fitted against the inside of the bottom 16 and the inside of the front 18'. The spacers 36 are separated by a slot 46, the purpose of which will become apparent later in the description of the preferred embodiment.

The spacers 36 and 48 have hook fabric glued or otherwise attached thereto adjacent the sides 12' and on the surfaces of the spacers opposite the inside of the bottom 16.

The case includes a pedal board 42 which includes loop fabric 40 adhesively, or otherwise attached to the four corners thereof in a position to mate with the hook fabric 38 contained on the spacers 36 and 48. FIG. 10 shows the board inverted to illustrate the placement of the loop fabric. In place of the hook and loop fabric, other known fastener devices could be use, for example and not by way of limitation, snaps, clips, and the like. The pedal board 42 has a cutout 44 so that it can be grasped by the musician at the cutout 44 with the slot 46 leaving room for the hand to pass beneath the pedal board and raise it so that it can be removed for access to the accessory storage space beneath the pedal board.

Amplified music accessory pedals 50 are mounted on one side of the pedal board 42 and are wired by wires 52 to connect the various pedals, either to each other in series, or parallel and ultimately to an external plug so that the amplified musical instrument can be connected, through one or more plugs 54, to the pedals 50. The wires 52 are sandwiched inside the outer surfaces of the pedal board 42 for protection. Alternatively, the wires can be mounted to the opposite side of the board or to the pedal side of the board so that pedals can be added or removed with greater convenience. In addition, a power cord plug similar to plug 54 is wired into one of the surfaces of the pedal board so that a power supply wire can be hooked to the board to provide power to all the pedals 50.

The pedal board 42 is placed inside the four walls of the bottom section 32 when the device is packed for transportation from one venue to another. In the preferred embodiment, the spacers provide room for accessories in the cavity between the pedal board 42 and the bottom 16. During set-up, the musician can storage cavity by placing his/her hand down through the cutout 44 and slot 46 to grip the pedal board and raise it from the bottom section of the case. A pulling force on the pedal board 42 will cause the hook and loop fabric to disengage and allow the pedal board 42 to be removed from the top section of the case.

In an alternate configuration, the pedals can be fit between the pedal board and the inside surface of the bottom 16 so that the pedals will be protected from damage during transportation. In the preferred embodiment, however, the pedals face upwardly and the board sits on the spacers 36, 48. The loop fabric 40 on the pedal board 42 will attach to the hook fabric 38 on the spacers to hold the pedal board in place and protect the pedals from damage during transportation.

When the musician reaches the music venue and begins set-up, he/she can open the case, remove the top section 30 from the bottom section 32 and set the top section to the side. The pedal board 42 is then exposed and ready for use. If stored accessories are needed, they can be removed from the storage cavity as described above.

As can be seen from the various figures, the edges of the sides 12 of the top and bottom sections are at an upwardly inclined angle from front to back when viewing the device from the side. That angle and the height of the spacers 36, 48, cause the pedal board 42 to sit at an incline so that when the musician places the bottom section of the device in front of him/her with the front positioned toward the musician and the back furthest from him/her, the higher back of the bottom section 32 of the device will hide the pedals from the audience but be readily accessible to the musician. The pedal board 42 can then be employed immediately after the musical instrument are plugged into the plug 54, a separate electric source is plugged into the pedal board to provide power to the pedals 50. With minimal time and effort, the musician is set to proceed with a performance. The pedals are readily available for access by the musician. The pedals normally being foot pedals that can be operated by the musician during the course of performance. In addition, some of the pedals may be knobs that must be adjusted by hand, but they are also conveniently accessible and can be readily adjusted during the course of performance without fear of damage to the pedal board.

In the preferred embodiment, all interior and exterior case walls and the instrument stand panels are finished with a urethane base spray or coating for protective and cosmetic purposes. The edges of the wells, which hold the instruments, are, preferable, lined with soft foam of felt, or a custom extruded rubber, to protect the instrument finishes. The shapes of the wells can be modified to accommodate different instruments. The primary use of the invention is anticipated to be in conjunction with guitars but the device may be modified for use with other instruments such as, but not limited to, mandolins, banjos, electric/acoustical bases, violins and other instruments as well as amplified wind instruments that might require musical pedal accessories. The case can also be used for repair technicians for guitars ("luthiers") using diagnostic and repair devices attached to the pedal effects board and storing tools in the chamber 34. As a tech table, the pedal board is covered with a fabric or other soft material so that the board can serve as a worktable for the luthier.

The storage cavity 34 is for accessories such as spare strings, picks, cords, microphones, maintenance equipment; and even other small musical instruments such as tambourines, harmonicas and the like.

The hinges 24 can be replaced with releasable clasps, which can be either on the rear or the two sides of the sections of the case. The device can be provided with wheels and a telescoping handle as is known in the industry and other various modifications of the invention may be made by those ordinarily skilled in the art without varying from the scope of the invention as is more particularly set forth in the following claims.

What is claimed is:

1. A device to facilitate the set-up by musicians for live musical performances including:

a. a box for transporting musical accessories, a guitar stand and a pedal effects board;

b. said box divided into two sections, each having a storage chamber, said sections being hingedly connected permitting said box to be opened;

c. a pedal effects board with at least one musical effects pedal mounted thereon and said at least one musical effects pedal pre-wired on said pedal effects board;

d. said pedal effects board fitted in the storage chamber of one section of said box; and e. a guitar stand fitted in the storage chamber of the other section of said box.

2. The device of claim 1 wherein the hinged connection of the two sections includes a hinge that allows the two sections to be disengaged when the said box is open.

3. The device of claim 1 wherein said pedal affects board is removably fitted in the storage chamber of one of said sections of said boxes.

4. The device of claim 3 further including spacers in the storage chamber of said one section with said pedal affects board abutting said spacers whereby pedal affects board, when butted against said spacers, encloses the storage chamber of said one section of said box.

5. The device of claim 4 wherein said box has a bottom and said pedal affects board is spaced from said bottom and in a plane angled relative to said bottom.

6. The device of claim 1 wherein said guitar stand is collapsible into a storage configuration and expandable into an operable configuration.

7. The device of claim 1 wherein said guitar stand is hingedly connected to the inside of the storage chamber of the said other section of said box.

8. The device of claim 6 wherein said guitar stand, when expanded to the operable configuration, forms at least one well for at least one guitar.

9. The device of claim 8 wherein there are multiple guitar wells.

10. The device of claim 1 wherein said guitar stands includes two panels hingedly connected to each other.

11. The device of claim 10 wherein said two panels fold flat against each other in a collapsed position for storage and can be spread to an open position to create a guitar stand.

12. The device of claim 11 wherein said panels fit within the chamber of said other section to prevent the panels from spreading beyond a predetermined angular relationship.

13. The device of claim 10 where each of said panels includes at lease one slot with said slots intersecting to form an open well to serve as a guitar support.

14. The device of claim 13 where there are multiple slots in each panel, with said slots mirroring each other and intersecting so as to form multiple guitar wells in said stand.

15. The device of claim 1 wherein multiple musical effects pedals are mounted on said pedal effects board.

16. The device of claim 15 wherein said multiple musical effects pedals are wired in series and a plug is provided for connection of said pedals to an external power source.

17. The device of claim 15 wherein said multiple musical effects pedals are wired in parallel and a plug is provided for connection of said pedals to an external power source.

18. The device of claim 15 wherein said multiple musical effects pedals are wired in series and a plug is provided for connection of said pedals to an amplified musical instrument.

19. The device of claim 15 wherein said multiple musical effects pedals are wired in parallel and multiple plugs are provided for connection of said pedals to an amplified musical instrument.

20. The device of claim 15 wherein said multiple musical effects pedals are connected by wiring that is sandwiched inside said pedal effects board.

21. A musical instrument technician repair kit including:

a. a box for transporting tools for use in repairing musical instruments and a musical instrument stand;

b. said box divided into two sections, each having a storage chamber, said sections being hingedly connected permitting said box to be opened;

c. a repair board covered in a soft material, said board sized to fit within one of said storage chambers and removably connected to and cooperating with one of said sections to enclose said storage chamber creating a tool storage area therein; with said board serving as a repair table for the technician; and d. a guitar stand fitted in the storage chamber of the other section of said box.

* * * * *